US011195681B2

(12) United States Patent
Tetik

(10) Patent No.: US 11,195,681 B2
(45) Date of Patent: Dec. 7, 2021

(54) CIRCUIT BREAKER WITH ADDABLE TRIPPED INDICATOR

(71) Applicant: Eaton Intelligent Power Limited, Dublin (IE)

(72) Inventor: Adolf Tetik, Vienna (AT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 220 days.

(21) Appl. No.: 16/467,519

(22) PCT Filed: Dec. 6, 2017

(86) PCT No.: PCT/EP2017/081748
§ 371 (c)(1),
(2) Date: Jun. 7, 2019

(87) PCT Pub. No.: WO2018/104409
PCT Pub. Date: Jun. 14, 2018

(65) Prior Publication Data

US 2020/0006027 A1 Jan. 2, 2020

(30) Foreign Application Priority Data

Dec. 9, 2016 (DE) ..... 10 2016 123 957.7

(51) Int. Cl.
*H01H 71/04* (2006.01)
*H01H 71/02* (2006.01)
*H01H 71/52* (2006.01)

(52) U.S. Cl.
CPC ..... *H01H 71/04* (2013.01); *H01H 71/0207* (2013.01); *H01H 71/528* (2013.01)

(58) Field of Classification Search
CPC .. H01H 71/04; H01H 71/0207; H01H 71/528; H01H 2071/046; H01H 9/16; H01H 71/465; H01H 71/0228
USPC ..... 200/308; 335/13, 17; 337/79
See application file for complete search history.

(56) References Cited

U.S. PATENT DOCUMENTS 2,222,312 A * 11/1940 Green ..... H01H 73/24 337/48
4,609,895 A 9/1986 Westermeyer
4,801,906 A * 1/1989 Morris ..... H01H 71/465 335/13
6,107,902 A * 8/2000 Zhang ..... H01H 71/04 200/308
6,246,304 B1 6/2001 Gasper
(Continued)

FOREIGN PATENT DOCUMENTS

DE 602004003328 T2 4/2007
DE 102006009228 A1 9/2007
(Continued)

*Primary Examiner* — Edwin A. Leon
(74) *Attorney, Agent, or Firm* — Leydig, Voit & Mayer, Ltd.

(57) ABSTRACT

A circuit breaker includes: a tripped indicator for indicating a tripping of the circuit breaker, the tripped indicator having a first pivot element mounted on a first pivot pin; and a switch lock with a pawl pivotally mounted on a pawl pin. The first pivot element is actuated by the pawl to indicate a tripped condition of the circuit breaker. The first pivot pin is arranged substantially normal to the pawl pin.

9 Claims, 5 Drawing Sheets

(56) References Cited

U.S. PATENT DOCUMENTS

| | | | | |
|---|---|---|---|---|
| 6,803,535 | B1 * | 10/2004 | Whipple | H01H 71/04 200/308 |
| 8,610,012 | B2 | 12/2013 | Liebetruth | |
| 2009/0015357 | A1 | 1/2009 | Ahn | |

FOREIGN PATENT DOCUMENTS

| | | | |
|---|---|---|---|
| DE | 102010022596 | A1 | 12/2011 |
| DE | 102010036222 | A1 | 3/2012 |
| EP | 0144691 | A1 | 6/1985 |
| WO | WO 2005031778 | A1 | 4/2005 |

* cited by examiner

CIRCUIT BREAKER WITH ADDABLE TRIPPED INDICATOR

CROSS-REFERENCE TO PRIOR APPLICATIONS

This application is a U.S. National Phase application under 35 U.S.C. § 371 of International Application No. PCT/EP2017/081748, filed on Dec. 6, 2017, and claims benefit to German Patent Application No. DE 10 2016 123 957.7, filed on Dec. 9, 2016. The International Application was published in German on Jun. 14, 2018 as WO 2018/104409 under PCT Article 21(2).

FIELD

The invention relates to a circuit breaker.

BACKGROUND

There are known circuit breakers which have a mechanically formed optical display for displaying a contact position of the relevant switching device, therefore displaying whether the contacts are closed or opened.

There are also known circuit breakers which have a mechanically formed optical display which indicates whether or not the relevant circuit breaker has been triggered by the response of a trigger in the circuit breaker.

Such mechanically controlled displays must map the state of certain parts of a switch lock of a circuit breaker. In this context, a switch lock is already a complex mechanical instrument without an appropriate display means. Known displays are an integral part of a switch lock. Although it is often possible to omit the mechanical components that belong to a display when manufacturing the switch lock, the decision whether the circuit breaker which is produced at the end should have such a display must be made relatively early in a manufacturing process. Using a display at a late stage of production is not possible with known circuit breakers.

In particular, in known circuit breakers, a simple extension of an existing switch lock that is both mechanically and electrically tested is not possible. An extension to include an additional display usually requires a redesign or at least a far-reaching redesign of the relevant switch lock.

SUMMARY

In an embodiment, the present invention provides a circuit breaker, comprising: a tripped indicator configured to indicate a tripping of the circuit breaker, the tripped indicator having a first pivot element mounted on a first pivot pin; and a switch lock with a pawl pivotally mounted on a pawl pin, wherein the first pivot element is configured to be actuated by the pawl to indicate a tripped condition of the circuit breaker, and wherein the first pivot pin is arranged substantially normal to the pawl pin.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
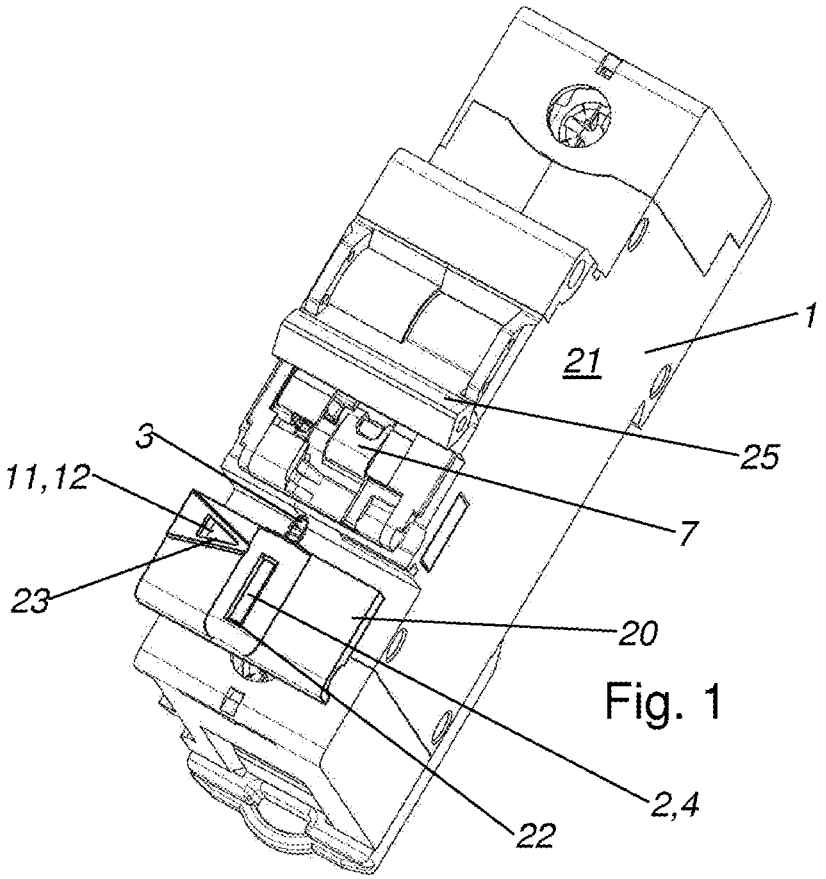
FIG. 1: an embodiment of a subject-matter circuit breaker in an axonometric view with the housing cap pushed away.
Figure 2:
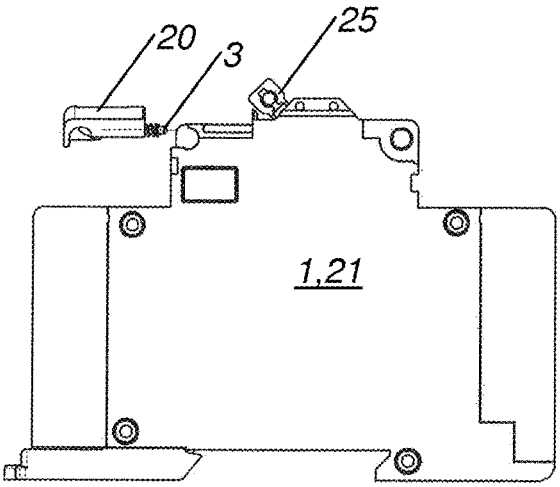
FIG. 2: the circuit breaker according to FIG. 1 in elevation with the housing cap pushed away.
Figure 3:
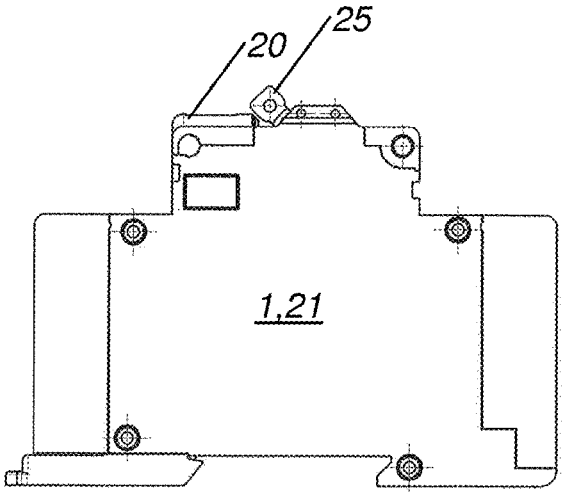
FIG. 3: the circuit breaker according to FIG. 1 in elevation with attached housing cap.

In an embodiment, the present invention provides a circuit breaker of the type mentioned, using which the mentioned disadvantages can be avoided, in which a simple extension of a circuit breaker to include an indication of the switching position is possible, and which can be produced easily and with little effort.

As a result, a circuit breaker that has already been designed and tested can be supplemented to include a tripped indication of the type of tripping without significant design intervention in the switch lock. Only minor adjustments to a few parts of the switch lock are required for this purpose.

This makes it possible to decide whether or not to equip the circuit breaker at a relatively late stage of manufacture with a corresponding display. The relevant decision must be made before the final assembly of the relevant circuit breaker in the circuit breaker housing. In this case, both circuit breakers with such a tripped display, as well as those without the tripped display, have identical switch locks, whereby production and storage are simplified.

By means of the first pivot pin arranged at right angles to the pawl pin, a simple sliding or insertion of a display part onto or in the circuit breaker is possible, and thereby a simple coupling of the first pivot element with the switch lock is also possible. Likewise, this provides simple control of the first pivot element.

FIGS. 1 to 13 show a preferred embodiment of a circuit breaker 1 or parts of the relevant circuit breaker 1, wherein circuit breaker 1 has a tripped display 2 for indicating a tripping of the circuit breaker 1, wherein the tripped display 2 has, at a first pivot pin 3, the first pivot element 4, wherein the circuit breaker 1 has a switch lock 5 with a pawl 7 mounted pivotally on a pawl pin 6, wherein the first pivot element 4 is activated to display a tripped state of the circuit breaker 1 by the pawl 7, wherein the first pivot pin 3 is arranged substantially normal to the pawl pin 6.

As a result, an already designed and tested circuit breaker 1 can be supplemented to include a tripped display 2 of the type of triggering without significant structural interference in the switch lock 5. Only minor adjustments to a few parts of the switch lock 5 are required for this purpose.

This makes it possible to equip—or not—the circuit breaker 1 with a corresponding display even at a relatively late point in production. The decision in question need only be made before the final assembly of the relevant circuit breaker 1 in the circuit breaker housing 21. In this case, both circuit breakers 1 having such a tripped display 2 and those without the tripped display 2 have identical switch locks 5, whereby production and storage are simplified.

By means of the pivot pin 3 arranged at right angles to the pawl pin 6, a simple sliding or insertion of a display part on or in the circuit breaker 1 is possible, and thereby a simple coupling of the first pivot element 4 with the switch lock 5 is also possible. Likewise, simple control of the first pivot element 4 is provided as a result.

The subject-matter switching device is a circuit breaker 1, which is designed in particular as a circuit breaker, a power switch and/or a motor protection switch or the like. The relevant circuit breaker 1 has at least one trigger, which trips the circuit breaker 1 when certain states occur, in particular when an overcurrent or a short-circuit current through the circuit breaker 1 occurs. The term "trigger" is understood in particular to mean that the trigger performs a mechanical movement in response to a particular state, and that such a switch lock 5 of the circuit breaker 1 is actuated, whereby switching contacts of the circuit breaker 1 are disconnected, as in known and commonly used circuit breakers. Switching devices designed in this manner are also referred to as automatic switches.

The tripping of the circuit breaker 1 is carried out either by a trigger, which is part of the relevant circuit breaker 1 itself, or from the outside, by a separate trigger or other switching device, which are mechanically coupled to the circuit breaker 1.

The circuit breaker 1 exhibits a switch lock 5 in a conventional manner. The switch lock 5, which is not described in detail presently, has, also in a conventional manner, a contact arm carrier 14 on which the at least one movable switching contact of the circuit breaker 1 is mounted, and on which the pawl 7 is rotatably mounted by means of the pawl pin 6. The pawl 7 is connected via a bracket 24 or a rod to the manual switch lever 25 of the circuit breaker 1.

The switch lock 5 further has a pawl support 26. The pawl support 26 has a latching point for connection with the pawl 7, which is visible in FIG. 5. Starting from an off state of the circuit breaker 1 and in the so-called latched state, e.g. when the pawl 7 engages the pawl support 26, a movement of the manual switch lever 25 is transmitted to the pawl 7 via the bracket 24. Since the pawl 7 cannot give way or swing out due to the latch, the contact arm carrier 14 will also move as a result of the movement of the manual switch lever 25.

The circuit breaker 1 has a so-called tripped display 2, which is provided and designed to indicate whether the circuit breaker 1 has been tripped, either by a trigger of the circuit breaker 1 itself, or by an external trigger.

The triggered display 2 has a first pivot element 4 mounted on a first pivot axis 3. In this case, the first pivot element 4 has two areas whose design is optically different, a first display area 27 and a second display area 28, wherein, depending on the state of the switching device 1 with respect to its tripping, one of the two display areas 27, 28 is displayed through a first viewing window 22 of the circuit breaker 1, while the other display area 27, 28 is covered by a housing part.

For example, the two display areas 27, 28 have different colors.

When the circuit breaker 1 is tripped, the latching point between pawl 7 and pawl support 26 is separated. This is not done with a manual switching off of the circuit breaker 1 using the manual switch lever 25. The first pivot element 4 is actuated and moved to indicate a tripped state of the circuit breaker 1 of the pawl 7.

Circuit breakers 1 have a plurality of parts that are mounted to be pivotable or to be rotatable in places. In general, all axes of rotation or pivot pins are, at least in the region of the switching mechanism 5, arranged substantially parallel to one another. It is provided that, in the subject-matter circuit breaker 1, the first pivot pin 3 is arranged substantially normal to the pawl pin 6.

Figure 4:
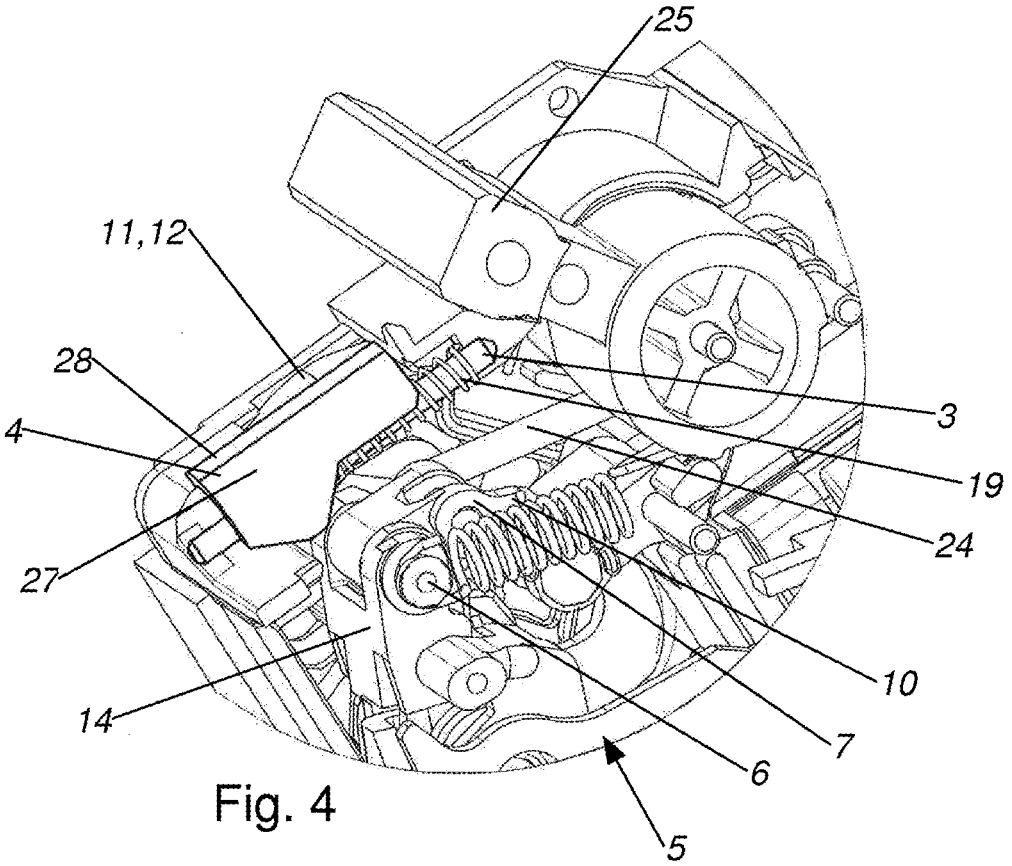
FIG. 4: a detailed view of a portion of the circuit breaker according to FIG. 1, wherein the circuit breaker is in the off state.
Figure 5:
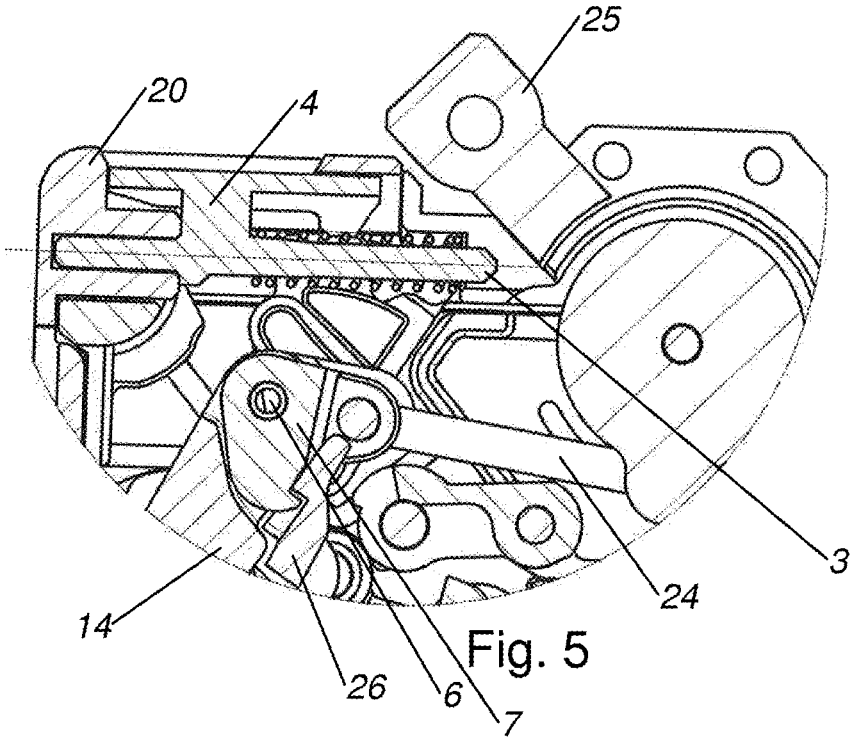
FIG. 5: a sectional view of the detailed portion according to FIG. 4 in elevation.

With respect to its rotatability, the first pivot element 4 is therefore arranged substantially perpendicular to the movement of the pawl 7 and is actuated or moved by the pawl 7 in case of tripping. For this purpose, the first pivot element 4 has (when viewed in the pivoting direction of the pivot element 4), an actuating surface 9 on a first pivot element 8, to which actuating surface 9 engages the pawl 7, after its movement in the course of a trigger, in order to rotate the first pivot element 4. The pawl 7 has an actuation extension 10 for this purpose. FIGS. 4 and 5 show views and areas of the switching mechanism 5, as well as the tripped display 2 in the switched-off state of the circuit breaker 1.

Figure 9:
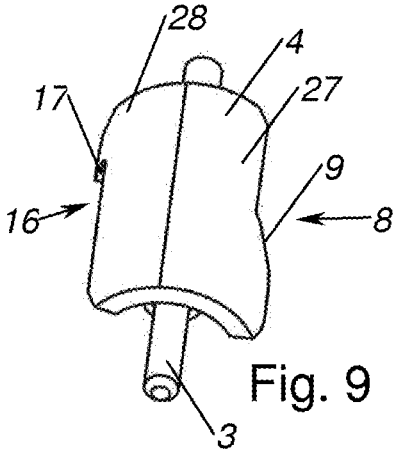
FIG. 9: a first axonometric view of the first pivot element of a circuit breaker according to FIG. 1.
Figure 10:
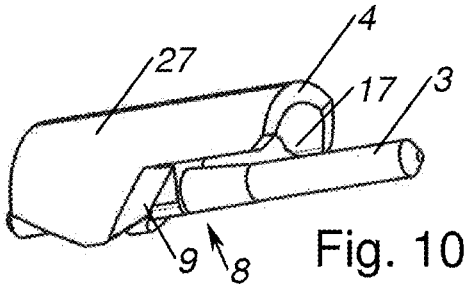
FIG. 10: a second axonometric view of the first pivot element according to FIG. 9.

FIGS. 9 and 10 show a preferred embodiment of the first pivot element 4. The first pivot element 4 essentially has the shape of a hollow cylinder segment, which is arranged on the first pivot axis 3. The first display area 27 and the second display area 28 are clearly visible in FIG. 9. The actuating surface 9 is arranged on the first pivot element side 8 as a lateral boundary surface of the hollow cylinder segment. According to the preferred embodiment, and as is particularly clearly visible in FIG. 10, the actuating surface 9 is formed as a surface inclined with respect to the first pivot pin 3. The transfer of power from the pawl 7 to the first pivot element 4 can be influenced by the specific shape of the actuating surface 9.

Figure 11:
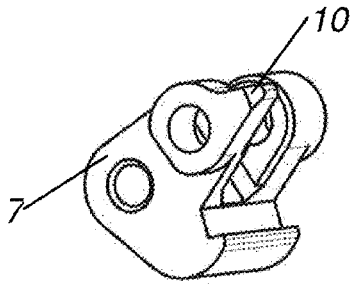
FIG. 11: an axonometric view of the latch of a circuit breaker according to FIG. 1.

FIG. 11 shows the pawl 7 according to the subject-matter circuit breaker 1. The pawl 7 is identical to a pawl 7 of a corresponding circuit breaker 1 without a tripped display 2 except for the actuating extension 10, and can also be used in such a circuit breaker with no disadvantages arising therefrom.

Figure 6:
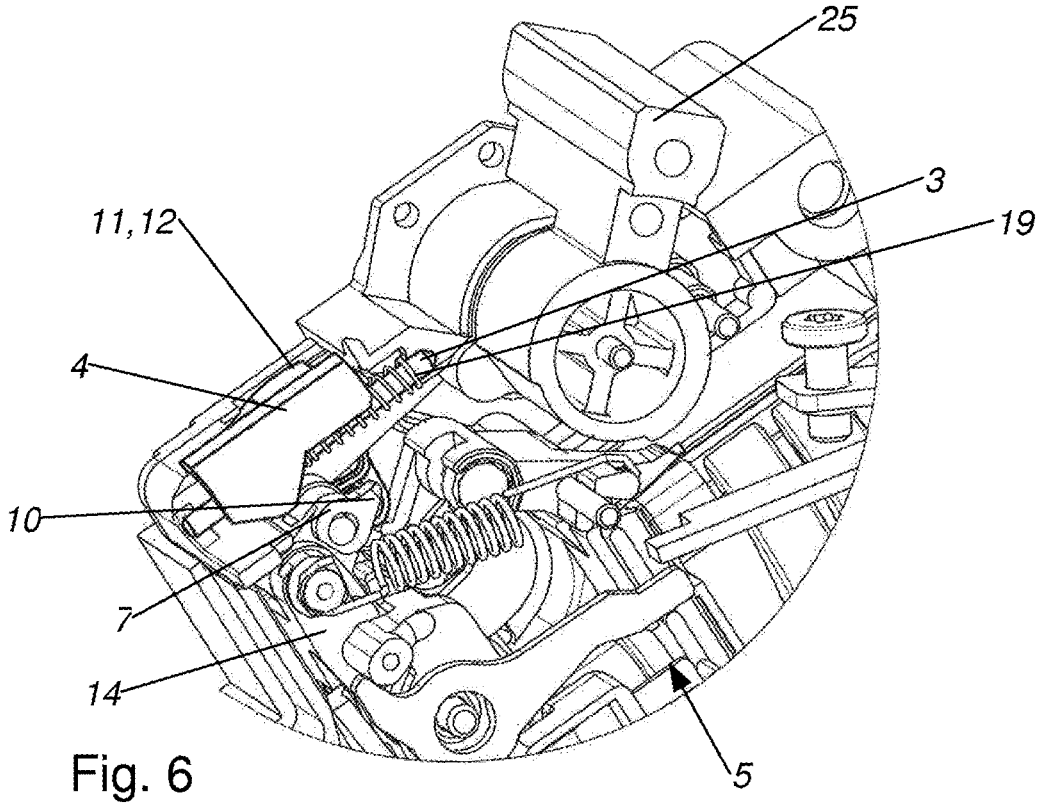
FIG. 6: the detailed portion according to FIG. 4, wherein the circuit breaker is in the on state.
Figure 7:
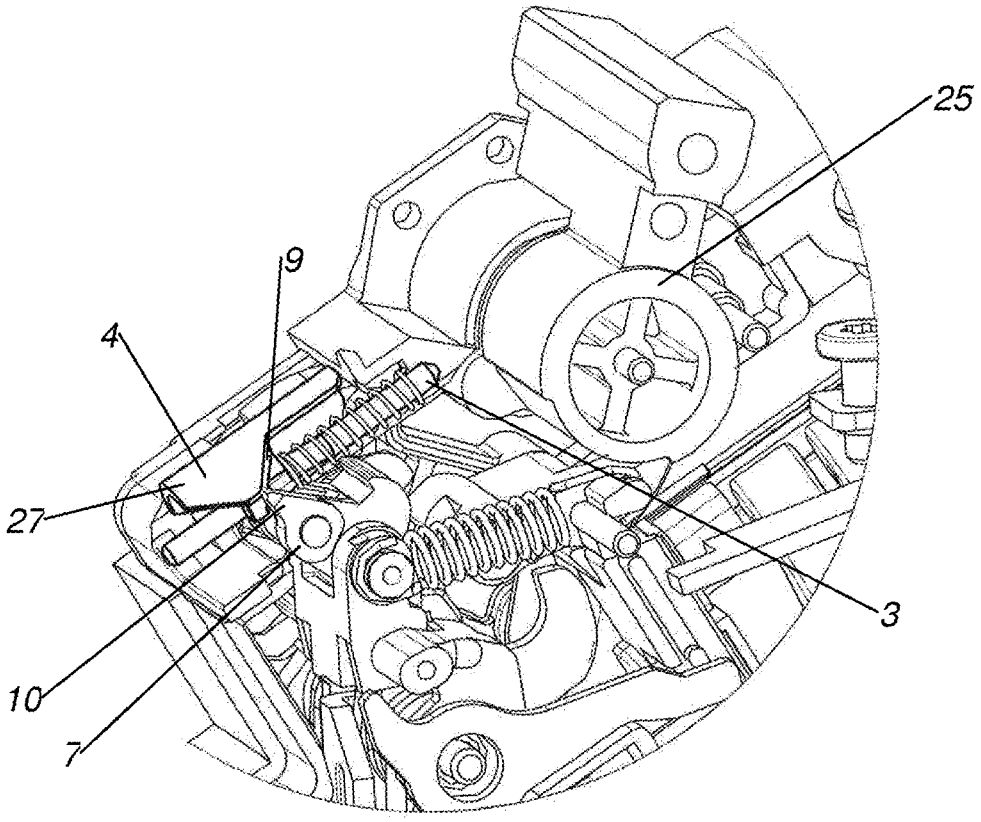
FIG. 7: the detailed portion according to FIG. 4, wherein the circuit breaker is in the off state after a so-called trip-free release, i.e., a release when the manual lever is locked.
Figure 8:
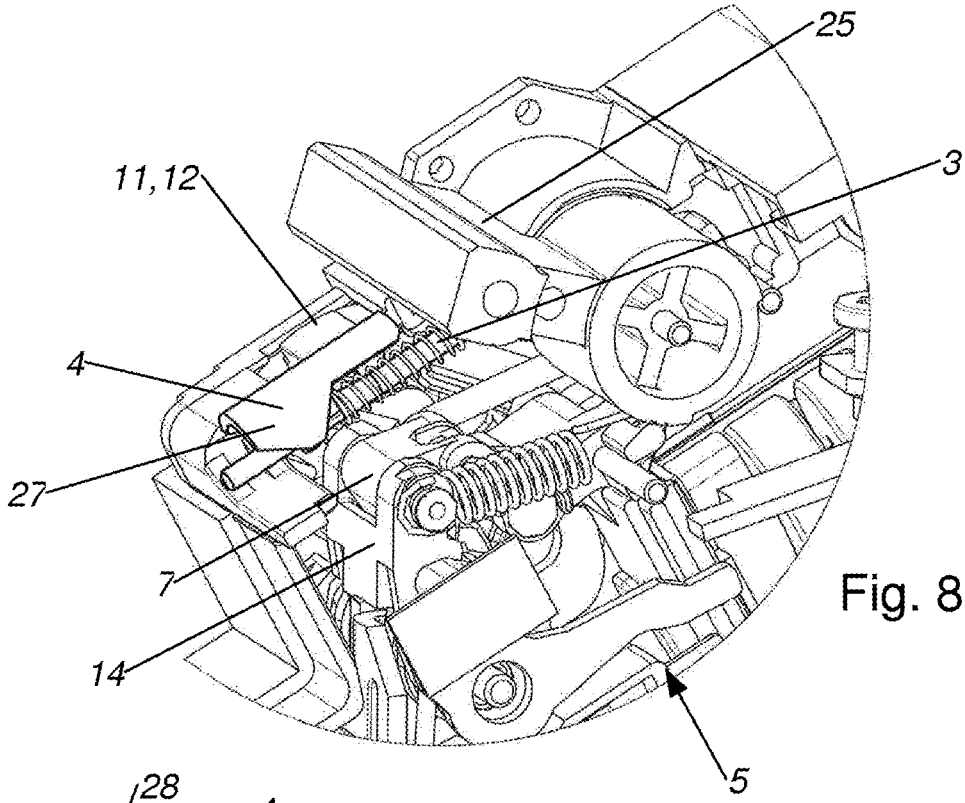
FIG. 8: the broken-away part according to FIG. 4, wherein the circuit breaker is in the off state after tripping.

Upon release of the circuit breaker 1, the latch is released and the pawl 7 pivots with the actuating extension 10 in the direction of the first pivot element 4. FIG. 6 shows the circuit breaker 1 in the on state. The pawl 7 and the first pivot element 4 are clearly visible. FIG. 7 shows the state immediately after the tripping. The latching is released, and the actuating extension 10 is applied to the actuating surface 9 of the first pivot element 4, which has already been turned. In this context, FIG. 7 shows the state of the circuit breaker 1 if the manual switch lever 25 is held in its on position, since springs in the circuit breaker 1 will otherwise cause an immediate triggering of the switching mechanism 5 again. This condition is shown in FIG. 8. The first pivot element 4 has been turned, but the pawl 7 is latched again in the switch lock 5.

It is preferably provided that the circuit breaker 1 comprises a switch position indicator 11 in addition to a tripped display 2. The switch position indicator 11 indicates the position of the switch contacts of the relevant circuit breaker 1, i.e. whether the switch contacts are closed, and whether such a conductive current path through the circuit breaker 1 exists, or whether the switch contacts are open and the flow of current through the circuit breaker 1 is prevented.

The switch position indicator 11 has a second pivot element 12, which is mounted on a second pivot pin, which is arranged substantially parallel to the pawl pin 6. The second pivot element 12 is in this case formed independently of the first pivot element 4, as is already apparent from the differently arranged pivot pins.

Figure 12:
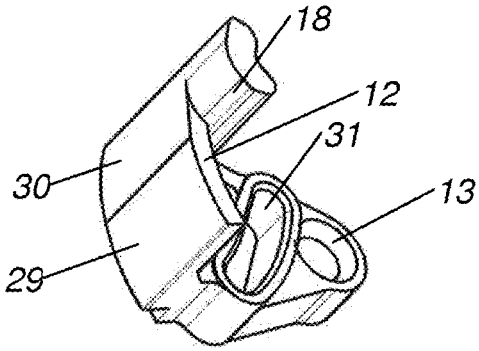
FIG. 12: an axonometric view of the second pivot element of a circuit breaker according to FIG. 1.

FIG. 12 shows a preferred embodiment of a second pivot element 12. Like the first pivot element 4, the second pivot element 12 also has two optically differently formed regions, a third display area 29 and a fourth display area 30, wherein only one of the two display areas 29, 30 is visibly represented through a second viewing window 23. FIG. 12 further shows the opening 13 for conducting the second pivot pin, on which the second pivot element is mounted.

As already stated, the pawl 7 is mounted by means of the pawl pin 6 on the contact arm carrier 14 of the switch lock 5. The contact arm carrier 14 has a contact arm extension which, according to the illustrated embodiment, engages in a control link 31 of the second pivot element 12. Since the position of the contact arm carrier 14 also corresponds to the actual position of the switching contacts, the switching position can be recorded and displayed in this way. The contact arm carrier extension of contact arm carrier 14 therefore controls the second pivot element 12.

As stated, when tripping the circuit breaker 1, the first pivot element 4 is moved by the pawl 7. Thereafter, as a rule, a latching of the pawl 7 occurs again, while the circuit breaker 1, however, remains in the tripped state with open switch contacts until it is turned on again, which is usually done by manual operation of the manual switch lever 25. However, until it is turned on again as said, the circuit breaker 1, the first pivot element 4, or rather the tripped display 2, remains in the state in which the latter indicates a tripping. However, when closing the switch contacts, therefore when switching on the circuit breaker 1, a reset of the tripped display 2 must also be done.

Figure 13:
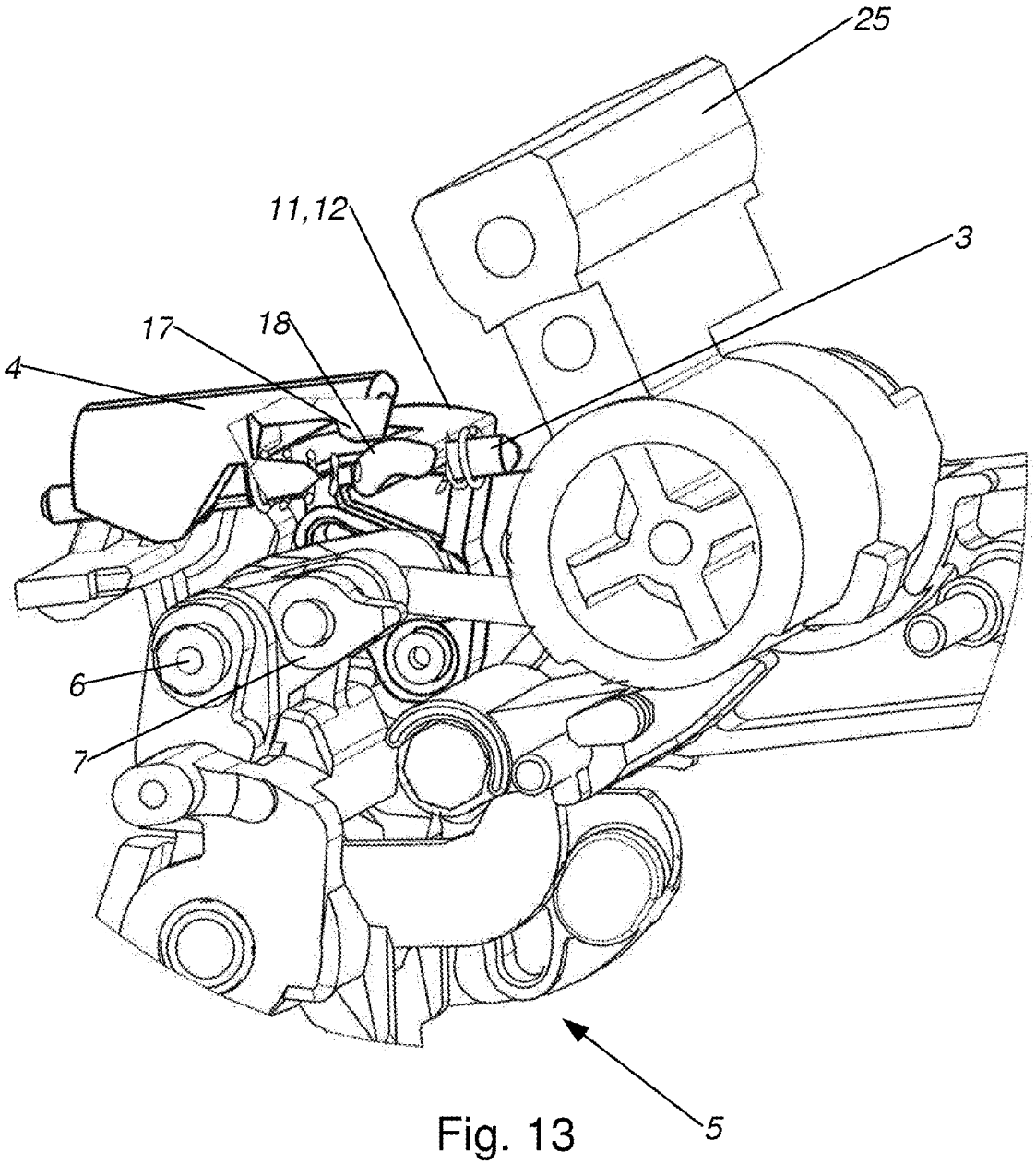
FIG. 13: an axonometric view of the detailed portion according to FIG. 4.

It is preferably provided that the first pivot element 4 has—in the pivoting direction of the pivot element 4—a reset surface 17 on a second pivot element side 16. In this case, the second pivot element 16 is also a side surface of the hollow cylinder segment. It is preferably provided that the second pivot element 12 has a reset extension 18. When the switching contacts of the circuit breaker 1 close, the reset extension 18 of the second pivot element 12 moves or turns the first pivot element 4 by pressing the reset extension 18 against the reset surface 17. FIG. 13 shows a part of the circuit breaker 1, in which case a part of the first pivot element 4 is shown broken-away, whereby the contact between the reset extension 18 and reset surface 17 is visible.

The function of displaying a trip, as well as the resetting in the event of a restart of the circuit breaker 1, are already implemented by the parts described above. In order to stabilize the respective position of the first pivot element 4, it is provided that the first pivot element 4 is acted on in the direction of the first pivot pin 3 by a compression spring 19. As a result, a low friction can be achieved, which is sufficient to prevent inadvertent or uncontrolled rotation of the first pivot element 4.

The circuit breaker 1 has a circuit breaker housing 21, which is preferably formed from an insulating material. The first pivot element 4 and the first pivot axis 3 are preferably arranged in a housing cap 20, which can be pushed along the longitudinal direction of the first pivot pin 3 onto the circuit breaker housing 21. In this case, essential components of the triggered display 2 are arranged in the housing cap 20. Therefore, depending on the selection of the type of housing cap 20, the circuit breaker 1 will or will not have a tripped indication. Since this housing cap 20 is pushed on only at the end of the manufacturing process of the circuit breaker 1, and all other parts are identical, the decision as to whether or not the circuit breaker 1 should have a tripped display 2 can be made only at the end of production, and it does not have to be made already at the beginning, or to be taken into account when, for example, constructing the switch lock 5. This achieves greater flexibility in production. In this context, FIGS. 1 to 3 clearly show how effectively the housing cap 20 can be pushed on.

The housing cap 20 further has a first viewing window 22, through which the first pivot element 4 is partially visible. Preferably, it is further provided that the housing cap 20 has a second viewing window 23, through which the second pivot element 12 is partially visible if such a second pivot element 12 is provided.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A circuit breaker, comprising:

a tripped indicator configured to indicate a tripping of the circuit breaker, the tripped indicator having a first pivot element mounted on a first pivot pin, the first pivot element having substantially a shape of a hollow cylinder segment and being a single piece element; and a switch lock with a pawl pivotally mounted on a pawl pin, wherein the first pivot element is configured to be actuated by the pawl to indicate a tripped condition of the circuit breaker, wherein the first pivot pin is arranged substantially normal to the pawl pin, and wherein the first pivot element and the first pivot pin are arranged in a housing cap, which is pushable along a longitudinal direction of the first pivot pin onto a circuit breaker housing of the circuit breaker.

2. The circuit breaker according to claim 1, wherein the first pivot element, in a pivoting direction of the pivot element, has an actuating surface on a first pivot element side configured to rotate the first pivot element through an actuating extension of the pawl in case of a trigger.

3. The circuit breaker according to claim 2, wherein the actuating surface is formed both as a lateral boundary surface of the hollow cylinder segment and as a surface inclined with respect to the first pivot pin.

4. The circuit breaker according to claim 1, further comprising a switching position indicator, wherein the switching position indicator has a second pivot element mounted on a second pivot pin, which is arranged substantially parallel to the pawl pin.

5. The circuit breaker according to claim 4, wherein the pawl is mounted by the pawl pin on a contact arm carrier of the switch lock, and wherein a contact arm carrier extension of the contact arm carrier is configured to control the second pivot element.

6. The circuit breaker according to claim 4, wherein the first pivot element has, in a pivoting direction of the pivot element, a reset surface on a second pivot element side configured to rotate the first pivot element by a reset extension of the second pivot element when switch contacts of the circuit breaker close.

7. The circuit breaker according to claim 1, wherein the first pivot element is configured to be acted upon in a direction of the first pivot pin by a compression spring.

8. The circuit breaker according to claim 1, wherein the housing cap has a first viewing window through which the first pivot element is partially visible.

9. The circuit breaker according to claim 1, wherein the housing cap has a second viewing window through which the second pivot element is partially visible.

* * * * *